US010655078B2

(12) United States Patent
Zweifel et al.

(10) Patent No.: US 10,655,078 B2
(45) Date of Patent: May 19, 2020

(54) FATTY AMINE ETHOXYLATE IN POLYALKYLENE GLYCOL BASED ENGINE OILS

(71) Applicant: Dow Global Technologies LLC, Midland, MI (US)

(72) Inventors: Daniel F. Zweifel, Horgen (CH); Evelyn A. Zaugg-Hoozemans, Horgen (CH); Stephan Höltschi, Oberrieden (CH)

(73) Assignee: Dow Global Technologies LLC, Midland, MI (US)

( * ) Notice: Subject to any disclaimer, the term of this patent is extended or adjusted under 35 U.S.C. 154(b) by 1 day.

(21) Appl. No.: 15/518,857

(22) PCT Filed: Oct. 8, 2015

(86) PCT No.: PCT/US2015/054579
§ 371 (c)(1),
(2) Date: Apr. 13, 2017

(87) PCT Pub. No.: WO2016/060915
PCT Pub. Date: Apr. 21, 2016

(65) Prior Publication Data

US 2017/0233673 A1 Aug. 17, 2017

Related U.S. Application Data

(60) Provisional application No. 62/064,693, filed on Oct. 16, 2014.

(51) Int. Cl.
*C10M 133/08* (2006.01)
*C10M 169/04* (2006.01)
*C10M 107/34* (2006.01)

(52) U.S. Cl.
CPC ..... *C10M 133/08* (2013.01); *C10M 107/34* (2013.01); *C10M 169/04* (2013.01); *C10M 2209/102* (2013.01); *C10M 2209/1033* (2013.01); *C10M 2209/1055* (2013.01); *C10M 2215/042* (2013.01); *C10M 2215/064* (2013.01); *C10M 2215/065* (2013.01); *C10M 2215/223* (2013.01); *C10M 2219/083* (2013.01); *C10M 2223/041* (2013.01); *C10M 2229/02* (2013.01); *C10M 2229/041* (2013.01); *C10N 2230/02* (2013.01); *C10N 2230/04* (2013.01); *C10N 2230/10* (2013.01); *C10N 2240/10* (2013.01)

(58) Field of Classification Search
CPC ..... C10M 133/43; C10M 2215/02
USPC ..... 508/562
See application file for complete search history.

(56) References Cited

U.S. PATENT DOCUMENTS

| | | | | |
|---|---|---|---|---|
| 5,900,392 | A | 5/1999 | Bernhard | |
| 6,265,360 | B1 * | 7/2001 | DeTar | C09K 8/524 508/314 |
| 9,273,266 | B2 | 3/2016 | Greaves et al. | |
| 9,353,340 | B2 | 5/2016 | Kawai et al. | |
| 9,447,358 | B2 | 9/2016 | Shimizu et al. | |
| 2003/0191033 | A1 | 10/2003 | Ryu et al. | |
| 2010/0037648 | A1 * | 2/2010 | Kaneko | C10M 169/04 62/468 |
| 2011/0207636 | A1 * | 8/2011 | Zhao | B60T 11/10 508/199 |
| 2013/0005633 | A1 * | 1/2013 | Habeeb | C10M 169/04 508/579 |
| 2013/0270049 | A1 * | 10/2013 | Sherman | C10M 169/044 188/266 |
| 2016/0002559 | A1 | 1/2016 | Raphaele et al. | |

FOREIGN PATENT DOCUMENTS

WO 2014066088 5/2014

OTHER PUBLICATIONS

International Preliminary Report on Patentability for related PCT Application PCT/US2015/054579, dated Apr. 27, 2017 (8 pgs).
International Search Report and Written Opinion for related PCT Application PCT/US2015/054579, dated Jan. 7, 2016 (13 pgs).
Khemchandani, "Characteristics of New Oil Soluble Polyalkylene Glycols"; The Dow Chemical Company, Feb. 9, 2011 (22 pgs).

* cited by examiner

*Primary Examiner* — Prem C Singh
*Assistant Examiner* — Francis C Campanell
(74) *Attorney, Agent, or Firm* — Brooks, Cameron & Huebsch, PLLC

(57) ABSTRACT

A composition contains a polyalkylene glycol and a fatty amine ethoxylate, the fatty amine ethoxylate having non-cyclic structure of structure (I). Where R is a linear, non-cyclic carbon-containing group with that is free of nitrogen, x and y are selected from a group consisting of zero and positive values provided that the sum of x and y are in a range of 8-20.

(I)

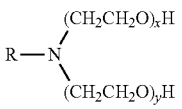

5 Claims, No Drawings

FATTY AMINE ETHOXYLATE IN POLYALKYLENE GLYCOL BASED ENGINE OILS

This application is a National Stage Application under 35 U.S.C. § 371 of International Application Number PCT/US2015/054579, filed Oct. 8, 2015 and published as WO 2016/060915 on Apr. 21, 2016, which claims the benefit to U.S. Provisional Application 62/064,693, filed Oct. 16, 2014, the entire contents of which are incorporated herein by reference in its entirety.

BACKGROUND OF THE INVENTION

Field of the Invention

The present invention relates to compositions containing fatty amine ethoxylate in polyalkylene glycol base oil.

Introduction

Engine oils tend to produce sludge and varnish when used over extended periods of time at elevated temperature. Sludge and varnish is undesirable in engine oil because it plugs oil filters and diminishes the lubricating efficacy of the oil. Diminished lubricating efficacy of engine oil results in increased friction in the engine and temperature of the engine, which further accelerates degradation of the oil and sludge formation. In order to reduce formation of sludge and varnish, engine oils typically contain a detergent. Detergents for conventional mineral oils have included calcium and magnesium sulphonates, phenates and slycilates. However, polyethylene glycol (PAG) base oils have different chemical environment than mineral oils. Therefore, engine oils comprising PAG base oils require different detergents than mineral oil-based engine oils.

WO2014066088 discloses use of an alkoxylated cyclic amine derivative for use as a soot dispersant in engine oils comprising a PAG base oil. The amine derivative has two cyclic amine groups per molecule.

WO2013141258A1 discloses a lubricant composition for internal combustion engines that comprising sulfur-containing heterocyclic compounds and amino alcohol compound.

WO2014128104 discloses an engine oil formulation with good anti-oxidant properties, good fuel economy properties and good anti-wear properties that comprises an amino compound. The amino compound contains at least three nitrogen atoms.

WO2012040174 discloses an engine oil formulation (PAG base oil) with a cycloaliphatic amine alkoxylate as an antioxidant additive.

WO2014050969 discloses a composition for removing deposits that already exist from inside an engine. The formulation is expressly distinguished from compositions for preventing deposits and is for use in engine flushing fluids (for use in engine up to 10 hours). Engine flushing fluid can have a PAG base oil. The formulation has a carboxylic acid and an amine. The amine is an alkyl amine.

A novel amine-based additive for PAG base oil formulations that serves as a sludge and varnish reducing agent is desirable. Desirably, the amine-based additive would not have to be cyclic or require more than one amine functionality, preferably no more than one nitrogen atom per molecule and is soluble in a PAG base oil.

BRIEF SUMMARY OF THE INVENTION

The present invention offers a solution to the problem of providing a novel amine-based additive for PAG base oil formulations that serves as a sludge and varnish reducing agent. The amine-based additive is non-cyclic and has no more than one amine functionality per molecule. Desirably, the amine-based additive has no more than one nitrogen atom per molecule and is soluble in a PAG base oil.

Surprisingly, it has been unexpectedly discovered that fatty amine ethoxylates having 8-20 —$CH_2CH_2O$— (EO) moieties act as sludge and varnish reducing agents in PAG base oils.

In a first aspect, the present invention is a composition comprising a polyalkylene glycol and a fatty amine ethoxylate, the fatty amine ethoxylate having a non-cyclic structure of structure (I):

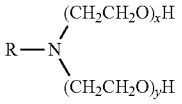

(I)

where R is a linear, non-cyclic carbon-containing group with that is free of nitrogen, x and y are selected from a group consisting of zero and positive values provided that the sum of x and y are in a range of 8-20

In a second aspect, the present invention is a method for treating an polyalkylene glycol base oil, the method comprising adding a fatty amine ethoxylate, the fatty amine ethoxylate having a non-cyclic structure of structure (I):

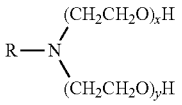

(I)

where R is a linear, non-cyclic carbon-containing group with that is free of nitrogen, x and y are selected from a group consisting of zero and positive integers provided that the sum of x and y are in a range of 8-20

The compositions of the present invention are useful as engine oil lubricants.

DETAILED DESCRIPTION OF THE INVENTION

"And/or" means "and, or alternatively". All ranges include endpoints unless otherwise stated.

Test methods refer to the most recent test method as of the priority date of this document unless a date is indicated with the test method number as a hyphenated two digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institut füNormung; and ISO refers to International Organization for Standards.

The composition of the present invention comprises a polyalkylene glycol (PAG). The PAG serves as a base oil in the formulation. Desirably, the PAG is present at a concentration of 50 weight-percent (wt %) or more, preferably 75 wt % or more, more preferably 80 wt % or more and can be present at a concentration of 85 wt % or more, 90 wt % or more and even 95 wt % or more of the total composition weight. Desirably, the PAG is a butanol-initiated PAG characterized by have a four-carbon ethoxy group on an end of the PAG.

The composition of the present invention also comprises a fatty amine ethoxylate having a non-cyclic structure of structure (I):

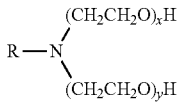

(I)

R is a linear, non-cyclic carbon-containing group with that is free of nitrogen. The term "non-cyclic" means free of any cyclic ring structure of atoms such as aromatic and non-aromatic carbon rings or heterocyclic ring structures including sulfur-containing and/or nitrogen-containing ring structures. Desirably, R is a hydrocarbon and more preferably a hydrocarbon with 12 or more and 18 of fewer carbon atoms.

x and y are selected from a group consisting of zero and positive values provided that the sum of x and y are in a range of 8-20. Desirably, the difference between x and y is three or less for optimal performance. The values for x and y are mole-average values determined by averaging the x and y values for all of the fatty amine ethoxylate molecules in the composition. Determine x and y values for a given sample by carbon(13) nuclear magnetic resonance spectroscopy ($^{13}$C-NMR). For the $^{13}$C-NMR method, prepare a homogeneous solution by dissolving three grams of sample material into 1.2 milliliters (mL) of a 0.025 molar $Cr(AcAc)_3$ solution of acetone-$D_6$ using a 10 millimeter NMR tube. $Cr(AcAc)_3$ serves as a relaxation agent for quantitative $^{13}$C-NMR. Acquire 13C-NMR spectra at room temperature using a Bruker AVANCE 400 megaherz spectrometer equipped with a 10 millimeter BBO probehead and the acquisition parameters of Table 1.

The resonances attributed to EO are present at a chemical shift of approximately 73 ppm (EO end groups), 72-70 ppm (EO chain), and 62-61 ppm (EO end groups net to OH), and possibly 69 ppm (EO/PO linkage). Use these signals for the calculation of the amount of EO. In case of overlapping signals (due to for instance the initiator, copolymer, etc.), corrections might be needed. An internal standard (for example, TMS) is added to calculate the amount of EO. If there is uncertainty in the calculation using TMS, assign all resonances in the $^{13}$C-NMR and calculate the weight-percent EO from the composition of the complete sample by summing to 100 weight-percent.

TABLE 1

| | | | |
|---|---|---|---|
| F2 - Acquisition Parameters | | ======= CHANNEL f1 ======= | |
| INSTRUM | dpx400 | NUC1 | 13C |
| PROBHD | 10 mm PABBO BB | P1 | 16.50 usec |
| PULPROG | zgig | PL1 | −6.00 dB |
| TD | 131072 | SFO1 | 100.6228298 MHz |
| SOLVENT | Acetone | ======= CHANNEL f2 ======= | |
| NS | 2048 | CPDPRG2 | bi_waltz65_64pl |
| DS | 4 | NUC2 | 1H |
| SWH | 23980.814 Hz | PCPD2 | 60.00 usec |
| FIDRES | 0.182959 Hz | PL2 | −5.00 dB |
| AQ | 2.7329011 sec | PL12 | 5.65 dB |
| RG | 256 | PL30 | 5.65 dB |
| DW | 20.850 usec | PL31 | −0.37 dB |
| DE | 6.50 usec | SFO2 | 400.1316005 MHz |
| TE | 296.5 K | F2 - Processing parameters | |

TABLE 1-continued

| | | | |
|---|---|---|---|
| D1 | 10.00000000 sec | SI | 131072 |
| d11 | 0.03000000 sec | SF | 100.6127690 MHz |
| L31 | 1 | WDW | EM |
| TD0 | 1 | SSB | 0 |
| | | LB | 1.00 Hz |
| | | GB | 0 |
| | | PC | 1.40 |

The fatty amine ethoxylate serves as a detergent in the PAG oil. Unlike conventional calcium and magnesium salt detergents, the fatty amine ethoxylates are soluble in PAG oil. Determine whether a component is soluble in a PAG oil by the following solubility test. Heat a base oil up to 80° C. while mixing in a beaker with a magnetic stirrer. Pour the additive in over time into the base oil while continuing to mix. Allow the mixture to cool while continuing to mix until the mixture reaches 25° C. If the mixture is clear enough to reads 12 point Times New Roman font through the mixture then the additive is classified as soluble in the base oil. Otherwise, the additive is not soluble. The detergency of the fatty amine ethoxylates is determined by a reduction in contaminants collected on the filter paper and less material on a glass surface in the oxidation test described in the Examples section below.

The composition of the present invention desirably comprises fatty amine ethoxylate at a concentration of at least 0.1 wt % or more, preferably 0.5 wt % or more, more preferably one wt % or more, yet more preferably 2 wt % or more, yet even more preferably 3 wt % or more and can comprise 4 wt % or more and at the same time typically comprises 10 wt % or less, preferably 9 wt % or less, yet more preferably 8 wt % or less, even more preferably 7 wt % or less and can comprise 6 wt % or less, 5 wt % or less and even 4 wt % or less where wt % is relative to total combined weight of PAG and fatty amine ethoxylate.

The fatty amine ethoxylate surprisingly produces an especially low oxidation residue when exposed to elevated temperatures (150 degrees Celsius (° C.), for example) and little viscosity change in the PAG oil. Surprisingly, it has been discovered that the values for x and y are important in achieving the low oxidation residue and low viscosity change as the Examples and Comparative Examples below illustrate. The term "low oxidation residue" means achieving a ranking of less than 6 in filter cleanliness and less than 4 in glass cleanliness in the oxidation test set forth in the Examples below. The term "little viscosity change" corresponds to less than 5 percent change in viscosity in the viscosity test set forth in the Examples below.

The importance of having low oxidation residue is that compositions of the present invention will be less likely to suffer from reduced lubricating efficacy due to oxidation byproducts. The compositions of the present invention may further require less antioxidant than typical lubricant formulations. Hence, compositions of the present invention are more stable to oxidation than other compositions even without antioxidants present.

Compositions of the present invention can further comprise additional additives such as viscosity index improvers, dispersants, defoamers, pour point depressants and yellow metal passivators. Desirably, the composition of the present invention is free of conventional detergents such as calcium sulphonates, salycilates and phenates.

The present invention also includes a method for treating a PAG base oil, the method comprising adding a fatty amine ethoxylate having a non-cyclic structure of structure (I).

EXAMPLES

Each of the following compositions (Examples and Comparative Examples) uses the base formulation of Table 2. The concentration is in weight-percent relative to the total weight of the base formulation.

TABLE 2

| Component | Composition | CAS Number | Source or Tradename | Concentration (wt %) |
|---|---|---|---|---|
| PAG Base Oil | A methyl capped, butanol initiated propylene glycol with 15 centiStoke kinematic viscosity at 40° C. and approximately 665 gram/mole weight-average molecular weight | 25736-79-2 | SYNALOX ™ 100-20B | 93.168 |
| Wetting Agent | Ethoxylated propoxylated di butyl amine bis phenol A | (none) | [synthesize as described below] | 2.00 |
| Antioxidant | aniline, N-phenyl, reaction product with 2,4,4-trimethylpentene | 068411-46-1 | IRGANOX ™ 5057 | 1.23 |
| Antioxidant | n-phenyl-1,1,3,3-tetramethylbutyl-naphthaline-1-amine | 068259-36-9 | IRGANOX ™ L06 | 1.84 |
| Corrosion Inhibitor | Tolyltriazole | 29385-43-1 | BASF | 0.15 |
| Acid Scavenger | Polyaspartic acid ester | 136210-30-5 | DESMOPHEN ™ NH 1420 | 0.29 |
| Extreme pressure/Anti wear additive | Triphenyl-thio-phosphate | 597-82-0 | IRGALUBE ™ TPPT | 1.03 |
| Extreme pressure/Anti wear additive | Dibenzyldisulfide | 150-60-7 | Fluka | 0.29 |
| Defoamer | Polydimethylsiloxane | 63148-62-9 | Dow Corning 200 12,500 cSt | 0.002 |

SYNALOX is a trademark of The Dow Chemical Company.
IRGANOX and IRGALUBE are trademarks of BASF SE Company.
DESMOPHEN is a trademark of Bayer Aktiengesellschaft Corporation.

Prepare the Wetting Agent by first preparing an intermediate and then subsequently reacting the intermediate to form the final wetting agent. Prepare the intermediate by introducing 378 kilograms (kg) of DER-331 epoxy resin (available from The Dow Chemical Company) to a reactor, replace the air in the reactor with nitrogen and then heat to 125° C. Add 246 kg di-butyl-amine (DBA) over the course of two hours. Once the DBA addition is complete, keep the reactor at 125° C. for two additional hours to complete the reaction. Add 11 kg of 45% aqueous potassium hydroxide solution to the reactor. Remove water by vacuum. Introduce 378 kg of a feed consisting of 30 wt % ethylene oxide and 70 wt % propylene oxide over a four hour period of time. After completing the addition, keep the reactor at 125° C. for 2.5 hours to obtain the intermediate.

Add 141 kg of the intermediate to a reactor and add 11 kg of 45% aqueous potassium hydroxide solution. Replace air in the reactor with nitrogen. Heat the reactor to 115° C. and remove water by vacuum from the reactor. Heat the reactor to 125° C. Add 214 kg of propylene oxide followed by 429 kg of a feed consisting of 10 wt % ethylene oxide and 90 wt % propylene oxide, followed by 214 kg of propylene oxide. The total addition time for these three additions is 10 hours. After completing the 10 hour addition, keep the reactor at 125° C. for 2.5 hours. Add magnesium silicate to adsorb catalyst and filter to isolate the wetting agent.

Prepare and then characterize the following Exs and Comp Ex compositions to determine solubility of components using the solubility test described earlier, kinematic viscosity at 40° C. (KV40) and 100° C. (KV100) according to ASTM method 445, viscosity index (VI) according to ASTM method D2270 and density at 15° C. according to ASTM method D7042-14.

Compositions

Comp Ex A. Comp Ex A is the base formulation of Table 2 with nothing further added. KV(40) is 17.42 centiStokes (cSt), KV(100) is 4.56 cSt. VI is 192. Density is 0.9787 grams per milliliter (g/mL).

Comp Ex B. Comp Ex B is 97 wt % base formulation of Table 2 and 3 wt % of a traditional calcium-based detergent additive package available as OLOA 219 sulfurized calcium alkyl phenate detergent from Chevron Oronite. The additive package is deemed insoluble in the base formulation so this Comp Ex is not run through the remaining characterizations.

Comp Ex C. Comp Ex C is 97 wt % base formulation of Table 2 and 3 wt % of the fatty amine ethoxylate bis-(2-hydroxyethyl)oleylamine which has a structure similar to that of Structure (I) where the sum of x and y is 2 and R is a C12-C14 hydrocarbon. The fatty amine ethoxylate is available as Ethomeen™ O-12 tertiary amine ethoxylate. Ethomeen is a trademark of Akzo Nobel Chemicals B.V. KV(40) is 18.29 cSt, KV(100) is 4.71 cSt. VI is 192. Density is 0.9758 g/mL. The composition components are soluble and produce a clear solution.

Comp Ex D. Comp Ex D is 97 wt % base formulation of Table 2 and 3 wt % of a fatty amine ethoxylate similar to that of Structure (I) but where the sum of x and y is 5 and R is a C18 hydrocarbon. The fatty amine ethoxylate is available as Genamin™ 0 050 coconut fatty amine ethoxylate. Genamin is a trademark of Farbwerke Hoechst Aktiengesellschaft Vormals Meister Luscious & Bruning Corporation. KV(40) is 18.41 cSt, KV(100) is 4.73 cSt. VI is 192. Density is 0.9777 g/mL. The composition components are soluble and produce a clear solution.

Comp Ex E. Comp Ex E is 97 wt % base formulation of Table 2 and 3 wt % of a fatty amine ethoxylate similar to that of Structure (I) but where the sum of x and y is 7 and R is a C12-C14 hydrocarbon. The fatty amine ethoxylate is available as Ethomeen™ OV/17 ethoxylated (7) oleylamine. Ethomeen is a trademark of Akzo Nobel Chemicals B.V. KV(40) is 18.21 cSt, KV(100) is 4.71 cSt. VI is 194. Density is 0.9784 g/mL. The composition components are soluble and produce a clear solution.

Ex 1. Ex 1 is 97 wt % base formulation of Table 2 and 3 wt % of a fatty amine ethoxylate similar to that of Structure (I) but where the sum of x and y is 8 and R is a C18 hydrocarbon. The fatty amine ethoxylate is available as Genamin™ O 080 coconut fatty amine ethoxylate. Genamin is a trademark of Farbwerke Hoechst Aktiengesellschaft Vormals Meister Luscious & Bruning Corporation. KV(40) is 18.50 cSt, KV(100) is 4.76 cSt. VI is 194. Density is 0.9786 g/mL. The composition components are soluble and produce a clear solution.

Ex 2. Ex 2 is 97 wt % base formulation of Table 2 and 3 wt % of a fatty amine ethoxylate similar to that of Structure (I) but where the sum of x and y is 10 and R is a C8-C18 (but primarily C12-C14) hydrocarbon. The fatty amine ethoxylate is available as Genamin™ C 100 coconut fatty amine ethoxylate. Genamin is a trademark of Farbwerke Hoechst Aktiengesellschaft Vormals Meister Luscious & Bruning Corporation. KV(40) is 18.49 cSt, KV(100) is 4.76 cSt. VI is 194. Density is 0.9795 g/mL. The composition components are soluble and produce a clear solution.

Ex 3. Ex 3 is 97 wt % base formulation of Table 2 and 3 wt % of a fatty amine ethoxylate similar to that of Structure (I) but where the sum of x and y is 20 and R is a C18 hydrocarbon. The fatty amine ethoxylate is available as Genamin™ 200. Genamin is a trademark of Farbwerke Hoechst Aktiengesellschaft Vormals Meister Luscious & Bruning Corporation. KV(40) is 18.77 cSt, KV(100) is 4.85 cSt. VI is 198. Density is 0.9801 g/mL. The composition components are soluble and produce a clear solution.

Further characterize the oxidation stability for Exs 1-3 and Comp Exs A and C-E. Comp Ex B is not tested because it did not pass the solubility test. Characterize oxidation stability, detergency, change in viscosity and deposit (glass and filter) results using the Oxidation Test described below. Results are summarized in Table 3.

Oxidation Test

Conduct the oxidation test by pouring 300 milliliters (mL) of lubricant composition into a glass tube (40 millimeters by 600 millimeters), which is heated to 150° C. for 168 hours using an electric heater. Blow air through the lubricant at a rate of 10 liters per hour. Include a copper and steel coil in the lubricant to act as a catalyst as described in method ASTM D 943.

Determine the kinematic viscosity at 40° C. (KV40) and 100° C. (KV100) of each lubricant composition before and after the oxidation test to determine a percent change in viscosity. Determine kinematic viscosity according to ASTM method D2270. A lubricant composition fails if the KV(40) or KV(100) changes by 5% or more.

Determine glass cleanliness by rating the cleanliness of the glass tube after the oxidation test, which characterizes the extent of varnish that forms on the glass tube surface. Pour the lubricant out of the glass tube carefully into a beaker and then characterize the cleanliness of the glass tube. The glass cleanliness is characterized according to a seven-point scale, a rating of 4 or higher constitutes failing:

1—less than 10% of upper glass tube is covered with varnish (clean)

2—10-20% of upper glass tube is covered with varnish

3—20-30% of upper glass tube is covered with varnish

4—30-40% of upper glass tube is covered with varnish

5—40-50% of upper glass tube is covered with varnish

6—50-60% of upper glass tube is covered with varnish

7—more than 60% of upper glass tube is covered with varnish (dirty)

Determine extent of sludge formation and detergency by evaluating filter cleanliness after filtering a sample of the lubricant once it reaches room temperature (25° C.). Once the lubricant cools to room temperature, remove 2 mL of the lubricant from the glass tube with a syringe and blend with 8 mL of ethanol (absolute for analysis, available from Merck KGaA Darmstadt) in a 50 mL glass beaker. Agitate the mixture and pour within 15 seconds over a 185 millimeter Whatman filter (quality: 0858½; diameter: 185 millimeter; weight: 75 grams per square meter; thickness: 170 micrometers; particle retention: 7-12 micrometers; filtration speed: 55 seconds according to Herzberg). Collect the filtrate in a 100 mL glass beaker. Allow the filter to set for 4 hours prior to characterization to ensure complete drainage.

Filter cleanliness is characterized in one of the following classifications. A classification of 6 constitutes failure.

1—less than 5% of the filter is covered in residue

3—10-20% of the filter is covered in residue

6—>20% of the filter is covered with residue.

If a lubricant composition fails any one of the characterizations it fails the evaluation as a whole. Results for each of the compositions of the present examples are in Table 3:

TABLE 3

| Composition | Additive Description in reference to Structure (I) | Glass Cleanliness Rating | Filter Cleanliness Rating | KV(40) Change (%) | KV(100) Change (%) | Pass/Fail |
|---|---|---|---|---|---|---|
| Comp Ex A | None | 5 | 1 | 8.04 | 7.55 | F |
| Comp Ex C | (x + y) = 2; R = C12-14 | 4 | 6 | 4.05 | 5.25 | F |
| Comp Ex D | (x + y) = 5; R = C18 | 3 | 3 | −37.29 | −39.34 | F |
| Comp Ex E | (x + y) = 7; R = C12-14 | 3 | 4 | −62.15 | −46.95 | F |
| Ex 1 | (x + y) = 8; R = C18 | 3 | 4 | 2.70 | 3.80 | P |
| Ex 2 | (x + y) = 10; R = C12-14 | 2 | 3 | −1.52 | −1.32 | P |
| Ex 3 | (x + y) = 20; R = C18 | 1 | 2 | 0.99 | 2.16 | P |

The data in Table 3 reveals that fatty amine ethoxylates of Structure (I) are both soluble in PAG oil and demonstrate surprisingly good oxidation stability, low varnish formation and good detergency as evidenced by passing grades in glass cleanliness, filter cleanliness and viscosity change when (x+y) is in a range of 8-20.

The invention claimed is:

1. A composition comprising a polyalkylene glycol and a fatty amine ethoxylate, wherein the is at polyalkylene glycol is a butanol-initiated polyalkylene glycol and is at least 95 weight percent of the composition and the fatty amine ethoxylate having a non-cyclic structure of structure (I):

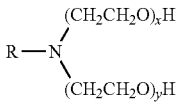

(I)

where R is a linear, non-cyclic carbon-containing group with that is free of nitrogen, x and y are selected from a group consisting of zero and positive values provided that the sum of x and y are in a range of 8-20, and wherein the fatty amine ethoxylate is at least 4 weight percent relative to a combined weight of the polyalkylene glycol and a fatty amine ethoxylate.

2. The composition of claim 1, where R is a hydrocarbon with 12 to 18 carbon atoms.

3. The composition of claim 1, where the fatty amine ethoxylate is five wt % or less based on the combined weight of polyalkylene glycol and fatty amine ethoxylate.

4. The composition of claim 1, where the value of x and y are within three integers of one another.

5. A method for treating a polyalkylene glycol base oil, the method comprising adding a fatty amine ethoxylate to the polyalkylene glycol base oil to form a composition wherein the polyalkylene glycol is a butanol-initiated polyalkylene glycol and is at least 95 weight percent of the composition, the fatty amine ethoxylate having a non-cyclic structure of structure (I):

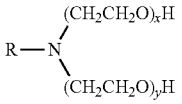

(I)

where R is a linear, non-cyclic carbon-containing group with that is free of nitrogen, x and y are selected from a group consisting of zero and positive integers provided that the sum of x and y are in a range of 8-20, and wherein the fatty amine ethoxylate is at least 4 weight percent relative to a combined weight of the polyalkylene glycol and a fatty amine ethoxylate.

* * * * *